United States Patent [19]

Masuda et al.

[11] Patent Number: 4,939,494

[45] Date of Patent: Jul. 3, 1990

[54] SURFACE-MOUNTED-TYPE INDUCTANCE ELEMENT

[75] Inventors: Yoshiaki Masuda; Hiraku Imaizumi; Takashi Shioura; Tadashi Mitsui; Tokio Tadano, all of Tokyo, Japan

[73] Assignee: TDK Corporation, Tokyo, Japan

[21] Appl. No.: 342,216

[22] Filed: Apr. 24, 1989

[30] Foreign Application Priority Data

Mar. 13, 1989 [JP] Japan ..... 64-28180[U]

[51] Int. Cl.[5] ..... H01F 27/02

[52] U.S. Cl. ..... 336/96; 336/98; 336/192; 336/198; 336/210

[58] Field of Search ..... 336/96, 205, 192, 210, 336/65, 212, 98, 90, 198, 208; 264/272.19

[56] References Cited

U.S. PATENT DOCUMENTS

| | | | |
|---|---|---|---|
| 2,464,029 | 3/1949 | Ehrman | 336/96 X |
| 3,258,728 | 6/1966 | Wiley et al. | 336/96 |
| 3,559,134 | 1/1971 | Daley | 336/96 |
| 4,352,081 | 9/1982 | Kijima | 336/198 |

*Primary Examiner*—Thomas J. Kozma
*Attorney, Agent, or Firm*—Helfgott & Karas

[57] ABSTRACT

A surface-mounted-type inductance element comprising a coil structure having a bobbin; the bobbin including a portion around which wires are coiled, a pair of flanges integrally formed at opposing ends of the bobbin, a pair of bases integrally formed at lower edge portions of the flanges in a manner to project laterally from the flanges, and a plurality of external terminals attached to each of the bases in a manner to penetrate the base, each the external terminal including a first portion projecting laterally from the base and a second portion projecting downward from the base, around which first portion of each the external terminal a termination of any one of the wires is wound; a mold covering the coil structure in a manner to allow the second portions of the external terminals to be projected outward from the mold, the mold being formed of resin material exhibiting heat resistance; and a pair of cores assembled to the coil structure through the mold.

29 Claims, 4 Drawing Sheets

SURFACE-MOUNTED-TYPE INDUCTANCE ELEMENT

BACKGROUND OF THE INVENTION

1. Field of the Invention

This invention relates to a surface-mounted-type inductance element such as a pulse transformer or the like which is assembled in a hybrid integrated circuit for a telecommunication equipment or a control device.

2. Description of the Prior Art

Referring now to FIG. 1, a conventional inductance element of this type will be described in order to facilitate understanding of the present invention. In FIG. 1, the conventional inductance element comprises a bobbin 1 having wires 2 coiled therearound and a pair of bases 3 integrally formed at opposing ends of the bobbin 1 in a manner to project laterally from the bobbin 1, from each of which bases 3 a plurality of external terminals 4 are projected outward, around which external terminals 4 terminations (not shown) of the wires 2 coiled around the bobbin 1 are wired; and a pair of cores 5 assembled to the bobbin 1. In the conventional inductance element, a coil portion is exposed to the external air, so that when the inductance element is mounted on a printed circuit board by, for example, reflow-soldering the external terminals 4 to conductive patterns which are previously formed on the printed circuit board, heat required in the reflow-soldering will badly affect the coil portion. In addition, cleaning of the inductance element mounted on the printed circuit board is generally carried out by using a solvent, so that the solvent will also badly affect the coil portion. Furthermore, since the coil portion is exposed to the external air as described above, the conventional inductance element is unable to resist moisture and is considerably susceptible to an external environment.

It is disclosed in Japanese Utility Model Registration No. 1,305,150 (Japanese Utility Model Publication No. 7320/1979) to TDK Corporation that, in order to overcome the disadvantages of the above-described conventional inductance element, the whole inductance element including a core is covered with plastic materials, with terminations of a wire coiled around the core being projected outward. However, in this case, when the whole essential parts of the inductance element including the core are covered with plastic materials by molding, stress associated with hardening of the plastic materials and stress associated with expansion and contraction of the plastic materials occuring due to a temperature change may degrade characteristics of the core. Concerning a low impedance electronic or electric component which constitutes an open magnetic circuit, such degradation of the characteristics may be tolerated to a certain extent, but, in regard to an electronic or electric component which is to constitute a closed magnetic circuit, the stresses as described above may cause cores to be separated from each other or destroy the cores, resulting in the magnetic characteristics of the electronic or electric component significantly deteriorating.

SUMMARY OF THE INVENTION

It is therefore an object of this invention to provide a surface-mounted-type inductance element which is unaffected by external environment.

It is another object of this invention to provide a surface-mounted-type inductance element which is resistant to heat and a solvent used on cleaning of the inductance element.

It is still another object of this invention to provide a surface-mounted-type inductance element, in which characteristics of cores are not degrated during assemblying.

It is yet another object of this invention to provide a surface-mounted-type inductance element, in which fixing operation of terminations of wires, which are coiled around a bobbin, to first portions of external terminals can be effectively carried out without damaging and badly affecting the bobbin and coil.

It is still a further object of this invention to provide a surface-mounted-type inductance element, in which bending operation of second portions of the external terminals for compatibility with surface-mounting of the inductance element can be carried out without causing cracks or other discontinuities to occur in the external terminals.

In accordance with the present invention, there is provided a surface-mounted type inductance element, comprising: a coil structure having a bobbin; the bobbin including a portion around which wires are coiled, a pair of flanges integrally formed at opposing ends of the bobbin, a pair of bases integrally formed at lower edge portion of the flanges in a manner to project laterally from the flanges, and a plurality of external terminals attached to each of the bases in a manner to penetrate the base, each of which external terminals comprises a first portion projecting laterally from the base and a second portion projecting downward from the base, around which first portion of each the external terminal a termination of any one of the wires is wound; a mold covering the coil structure in a manner to allow the second portions of the external terminals to be projected outward from the mold, the mold being formed of resin material exhibiting heat resistance; and a pair of cores assembled to the coil structure through the resin mold. The mold is formed of resin material having solvent resistance as well as heat resistance. The resin mold comprises a horizontal plate-like base portion enclosing the bases of the coil structure and the first portions of the external terminals, a step portion enclosing an essential part of the bobbin, and a horizontal plate-like top portion lying on the step portion in parallel with the base portion of the resin mold, to which step portion of the resin mold the cores are seated. The top portion of the resin mold is relatively smaller than the base portion of the resin mold. The cores constitute a closed magnetic circuit. Also, the cores may be tightly fastened to the coil structure by means of clips or self-adhering tapes. The second portions of the external terminals which are projected outwardly from the resin mold are bent along the outer surface of the resin mold. Further, the termination of each the wire is fixed to the corresponding first portion of the external terminal by spot welding or high-frequency welding which is capable of momentarily completing the fixing operation.

In one form of the present invention, the flanges of the bobbin are partially exposed from the resin mold, and a top surface of and both ends of each of the bases are exposed from the resin mold. The plate-like top portion of the resin mold is formed at one of its four sides with a recess which serves as means to specify a direction of the inductance element.

In a second form of the present invention, the plate-like top portion of the resin mold is formed at one its four sides with a notch, serving as means to specify a direction of the inductance element, in place of the recess of the first form of the present invention. The cores are fixed to the resin mold by means of ultraviolet-curing adhesives. Also, the cores is fixed at their substantially middle portions to the resin mold by the adhesives. Further, the cores may be fixed to the top portion of the resin mold by applying the adhesives to surfaces forming the notch and a portion of the top portion of the resin mold which is opposite to and in alignment with the forming position of the notch. The adhesives may be formed of modified acrylate which is anaerobic and has viscosity more than 5000 cP/cm. Also, the base portion of the resin mold may be formed with recesses at points of its bottom portion, from which the second portions of the external terminals project outwardly, each of the recesses formed in a manner to surround the corresponding second portion.

In a third form of the present invention, one of the flanges of the coil structure is formed with a plate-like projection which projects laterally from the flange the plate-like projection itself having a notch serving as means to specify a direction of the inductance element, and the coil structure is covered with the resin mold in a manner such that the appearance of the notch of the plate-like projection appears clearly.

BRIEF DESCRIPTION OF THE DRAWINGS

Other objects and many of the attendant advantages the present invention will be readily appreciated as the same becomes better understood by reference to the following detailed description when considered in connection with the accompanying drawings, in which like reference numerals designate the same parts throughout the FIGS. and wherein.

DETAILED DESCRIPTION OF THE PREFERRED EMBODIMENTS

Referring now to FIGS. 2 to 6, description will be made of a surface-mounted-type inductance element in accordance with the present invention. The surface-mounted-type inductance element comprises a coil structure covered with a mold, which is formed of resin material having heat resistance, for example, epoxy resin commercially available as EME-160E (provided by Sumitomo Bakelite Company, Ltd.) and a pair of cores assembled to the coil structure through the resin mold. The mold may be preferably formed of resin material which has solvent resistance as well as heat resistance.

Figure 1:
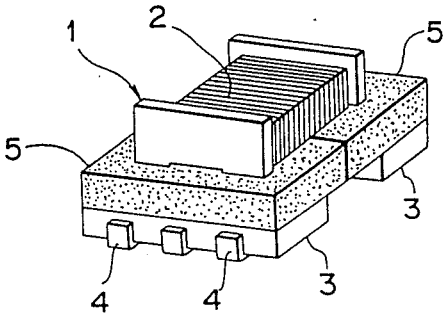
PRIOR ART FIG. 1
FIG. 1 is a schematic perspective view of a surface-mounted-type conventional inductance element.
Figure 2:
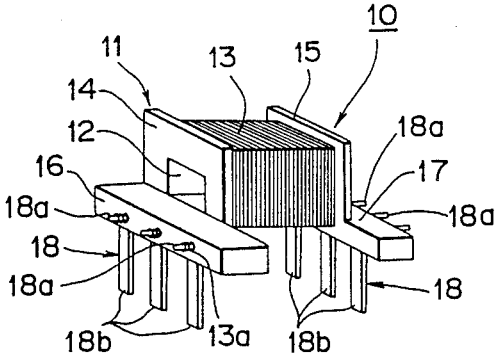
FIG. 2 is a schematic perspective view of a coil structure of a surface-mounted-type inductance element in accordance with the present invention.
Figure 3:
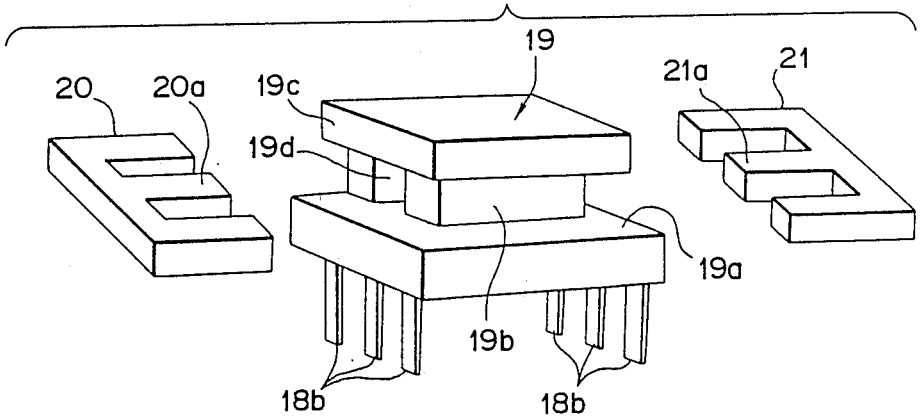
FIG. 3 is an exploded perspective view of the inductance element.
Figure 4:
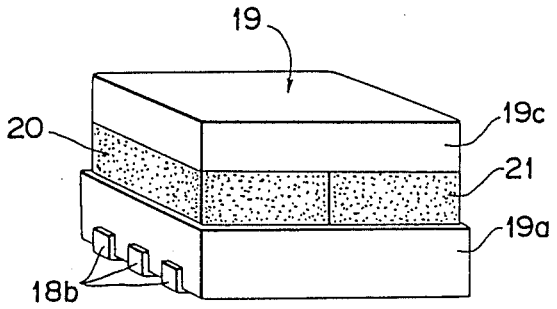
FIG. 4 is a schematic perspective view of the inductance element which is assembled.
Figure 5:
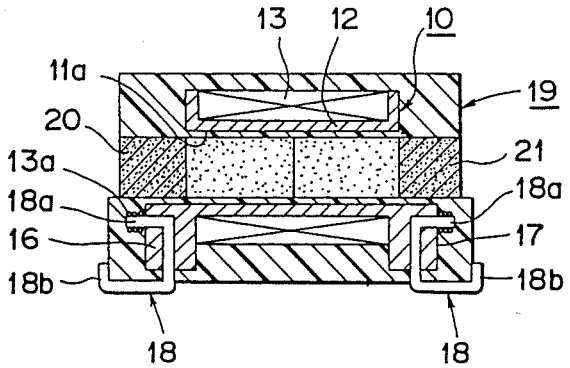
FIG. 5 is a sectional view of the inductance element of FIG. 4.

As shown in FIG. 2, the coil structure 10 comprises a bobbin 11. The bobbin 11 includes a portion 12 around which wires 13 are coiled, a pair of flanges 14 and 15 for regulating the winding of the wire 13 around the portion 12 and integrally formed at opposing ends of the wire coiled portion 12, and a pair of bases 16 and 17 integrally formed at lower end portions of the flanges 14 and 15 in a manner to project laterally from the flanges 14 and 15. A plurality of external terminals 18 are attached to each of the bases 16 and 17 in a manner to penetrate the base. Each of the external terminals 18 comprises a first projecting portion 18*a* projecting laterally from the base, and a second projecting portion 18*b* projecting downward from the base, around which first projecting portion 18*a* of the external terminal 18 a termination 13*a* of one of the coiled wires 13 is wound. Generally, it is necessary to prevent fraying of the termination 13*a* from the first portion 18*a* of the external terminal 18. For this purpose, the termination 13*a* of the wire 13, which is wound around the first portion 18*a* of the external terminal 18, may be metallurgically fixed to the first projecting portion 18*a* of the external terminal 18 by an ordinary soldering method. However, in the case where the termination 13*a* is fixed to the first projecting portion 18*a* of the external terminal 18 by the ordinary soldering method, the bobbin itself and a coil might be deteriorated by heat required in soldering. In order to solve such problem, in the illustrated embodiment, after the terminations 13*a* of the wires 13 are wound around the first projecting portions 18*a* of the external terminals 18, the wound terminations 13*a* are fixed to the first projecting portions 18*a* of the external terminals 18 by a welding method, in which welding-treatment can be momentarily completed, for example, spot welding or high-frequency welding. In such welding method, heat required in welding can be locally applied in a manner not to be applied to the bobbin and an essential part of the coil, and the welding-treatment can be momentarily completed as described above, so that the fixing of the terminations of the coiled wires to the first projecting portions of the external terminals can be performed without exerting undesirable effects on the bobbin 11 and the coil, compared to the ordinary soldering method. Therefore, the above-described welding method can significantly improve efficiency in assembling operation of the inductance element. Each of the second projecting portions 18*b* of the external terminals 18 is ultimately bent for compatibility with surface-mounting of the inductance element on a printed circuit board as will be described later. The external terminals 18 previously bent into substantially U-shapes in the manner illustrated in FIG. 5 may be provided in the bases 16 and 17. However, in this case, when winding of the terminations 13*a* of the wires 13 around the first projecting portions 18*a* of the so-bent external terminals 18 is carried out by an automatic winding machine, there is a possibility that the second projecting portions 18*b* of the bent external terminals 18 may hinder the winding operation. Such trouble may be avoided by making the second projecting portions 18*b* of the external terminals 18 shorter than the first projecting portions 18*a* of the external terminals 18 in a manner not to allow the second projecting portions 18*b* of the external terminals 18 to hinder the winding operation. However, this will make it difficult to automatically confirm, when the inductance element in accordance with the present invention is mounted on a printed circuit board by soldering, the soldering condition of the inductance element with respect to the printed circuit board by pattern recognition technology. In the illustrated embodiment, the winding operation of the terminations 13*a* of the wires 13 around the first projecting portions 18*a* of the external terminals 18 is carried out with leaving the second projecting portions 18*b* of the external terminals 18 straight as shown in FIG. 2 and, after the coil structure is covered with a resin mold 19 as shown in FIG. 3, the second projecting portions 18*b* of the external terminals 18 are bent as shown in FIGS. 4 and 5. Thus, in the illustrated embodiment, the winding operation can be efficiently carried out without any trouble by an automatic winding machine.

Figure 6:
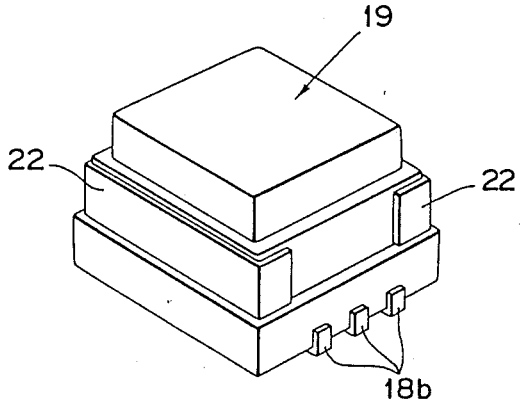
FIG. 6 is a schematic perspective view of the inductance element, in which cores are fastened to the coil structure by means of chips or self-adhering tapes.

After the coil structure 10 is assembled in the manner described above, the coil structure 10 is covered with the resin mold 19 briefly described above, with the second projecting portions 18*b* of the external terminals 18 being projected outside and being remained straight as shown in FIG. 3. The resin mold 19 comprises a horizontal plate-like base portion 19*a* enclosing the bases 16 and 17 and the first projecting portions 18*a* of the external terminals 18, a step portion 19*b* enclosing an essential part of the bobbin 11, and a horizontal plate-like top portion 19*c* lying on the step portion 19*b* in parallel with the base portion 19*a*. The top portion 19*c* of the resin mold 19 is formed slightly less than a size of the base portion 19*a* of the resin mold 19. In FIG. 3, reference numerals 20 and 21 designate a pair of substantially E-shaped cores which are employed for constituting a closed magnetic circuit. As shown in FIG. 4, the E-shaped cores 20 and 21 are assembled to the coil structure 10 which is covered with the resin mold 19. In the illustrated embodiment, the assembling of the cores 20 and 21 to the coil structure 10 can be easily carried out by putting the cores 20 and 21 on the base portion 19*a* of the resin mold 19 and sliding the cores 20 and 21 on the base portion 19*a* in a direction access to each other to fit middle portions 20*a* and 21*a* of the E-shaped cores 20 and 21 into a hole portion 19*d* of the step portion 19*b*, which covers a surface 11*a* (see FIG. 5) of a bore of the bobbin 11, so as to cause the middle portions 20*a* and 21*b* to come into close contact with each other in the hole portion 19*d* of the resin mold 19. The corse 20 and 21 assembled with respect to the coil structure 10 through the resin mold 19 in the manner described above are in a state of being interposed between the base portion 19*a* and top portion 19*c* of the resin mold 19, so that the cores 20 and 21 can be firmly supported to the coil structure 10 through the resin mold 19. In order to accomplish even firmer attaching of the cores 20 and 21 with respect to the coil structure 10, after the cores 20 and 21 are assembled to the coil structure in the manner described above, they are preferably fastened to the resin mold 19 by means of, for example, self-adhering tapes or clips 22 (see FIG. 6). As briefly described above, after the coil structure 10 is covered with the resin mold 19, the second projecting portions 18*b* of the external terminals 18 which are projected downward from the base portion 19*a* of the resin mold 19 and remained straight are flat bent, for compatibility with surface-mounting of the inductance element on a printed circuit board, along areas of the base portion 19*a* from a bottom surface of the base portion 19*a* to side surfaces of the base portion 19*a* as shown in FIGS. 4 to 6.

The surface-mounted-type inductance element constructed as described above is mounted on a printed circuit board by soldering the bent second projecting portions 18*b* of the external terminals 18 to conductive patterns which are previously formed on the printed circuit board. At this time, the surface-mounted-type inductance element may be automatically mounted on the printed circuit board together with other electronic components by reflow-soldering. During the reflow-soldering, even though heat required in the soldering operation is directly applied to a body of the inductance element, the heat is cut off by the resin mold 19 because of the heat resistance of the resin mold 19, so that the heat dose not reach the coil structure 10 contained in the resin mold 19. In connection with this, if such heat is locally applied between the conductive patterns on the printed circuit board and the second projecting portions 18*b* of the external terminals 18, the heat is prevented, by the resin mold 19, from being transferred to the cores 20 and 21. In addition, when the printed circuit board having the inductance element mounted thereon is subjected to a cleaning treatment using a solvent, there is no possibility that such solvent may badly affect the coil structure 10 contained in the resin mold 19 because the mold 19 is formed of resin material having solvent resistance as well as heat resistance as briefly described above. Likewise, since the coil structure 10 is not exposed to the external air, the coil structure 10 is prevented from being badly affected by moisture and dirt and/or dust. Furthermore, the cores 20 and 21 are assembled to the coil structure 10 from the outside of the resin mold 19, so that internal stress which may be produced, when resin material for the mold 19 harden and/or expansion and contraction of the resin material occur due to a temperature change during forming of the resin mold 19 by molding operation, is prevented from being exerted on the cores 20 and 21.

Figure 7:
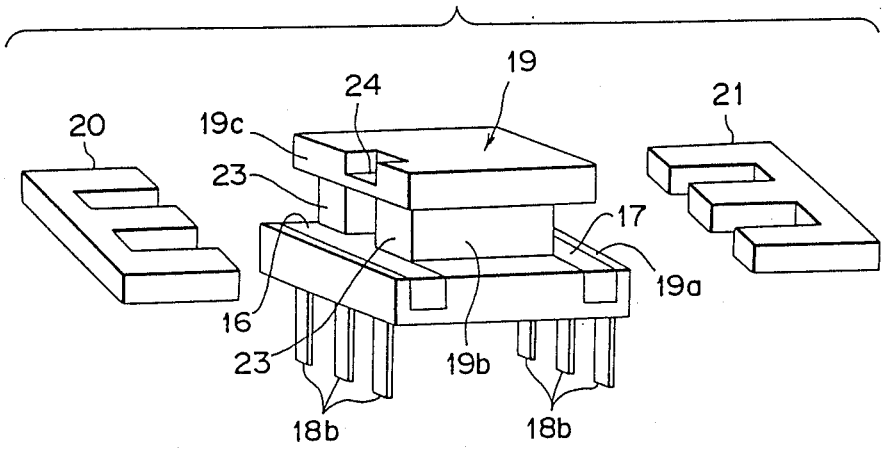
FIG. 7 is an exploded perspective view similar to FIG. 3 but shawing another form of the present invention wherein a top portion of a resin mold is provided with a recess serving as means to specify a direction of the inductance element, flanges of a bobbin are partially exposed from the resin mold, and a top surface of and both ends of each of bases are exposed from the resin mold.
Figure 8:
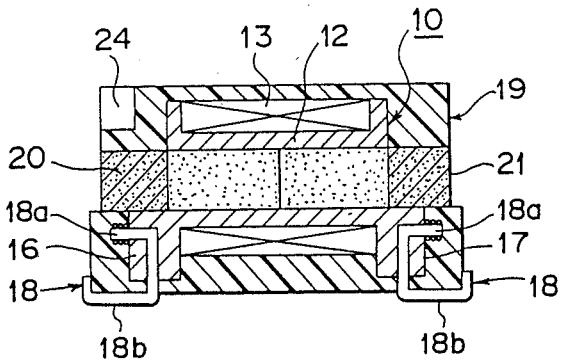
FIG. 8 is a sectional view of the inductance element of FIG. 7 which is assembled.
Figure 9:
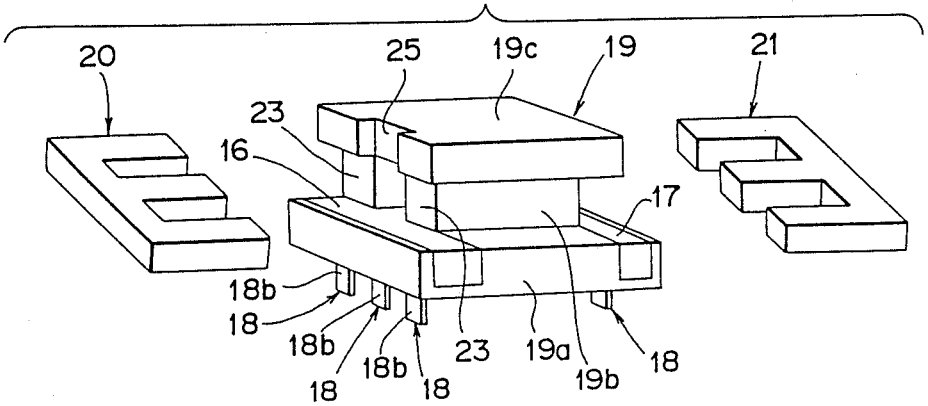
FIG. 9 is an exploded perspective view similar to FIG. 7 but showing still another form of the present invention wherein the top portion of the resin mold is provided with a notch in place of the recess shown in FIG. 7.

An alternative design for a surface-mounted-type inductance element in accordance with the present invention is shown in FIGS. 7 and 8. This alternative design is substantially similar to the surface-mounted-type inductance element of FIGS. 2 to 6 except that each of the flanges 14 and 15 of the bobbin 11 is exposed at its parts, illustrated generally at 23 in FIG. 7 (only the parts of the flange 14 of the bobbin 11 are shown in FIG. 7), from the step portion 19b of the resin mold 19; a top surface and both ends of each of the bases 16 and 17 are exposed from the base portion 19a of the resin mold 19; and the plate-like top portion 19c of the resin mold 19 is formed at one of its four sides with a recess 24. In the alternative design of FIGS. 7 and 8, components which are similar to those shown in FIGS. 2 to 6 are designated with like reference numerals and the description of them will not be repeated. The resin mold 19 in this alternative design is formed in a manner to allow the flanges 14 and 15 of the bobbin 11 and the bases 16 and 17 to be partially exposed from the resin mold 19 as described above, whereby the inductance element of this alternative design can be relatively miniaturized as a whole, so that an area of a printed circuit board on which the inductance element is mounted is narrowed. In this alternative design, the recess 24 formed in the top portion 19c of the resin mold 19 as described above serves as means to specify a direction of a transformer, for example, the primary side of the coil. When the inductance element is to be mounted on a printed circuit board by an automatic mounting apparatus, the recess 24 is sensed by means of, for example, optical processing means, whereby a mounting direction of the inductance element on the printed circuit board can be accurately specified.

Figure 10:
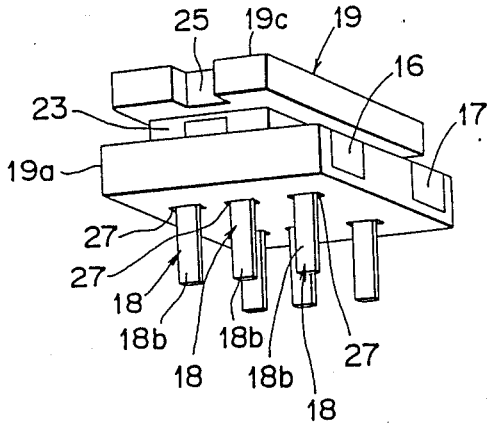
FIG. 10 is a schematic perspective view of a coil structure shown in FIG. 9.
Figure 11:
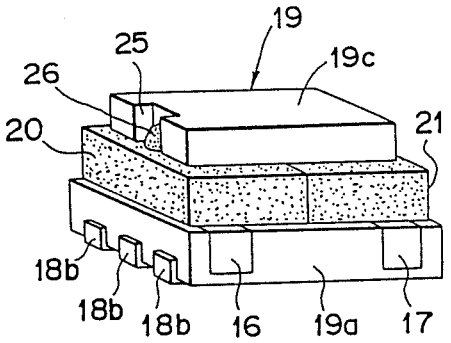
FIG. 11 is a schematic perspective view of the inductance element of FIG. 9 which is assembled.
Figure 12:
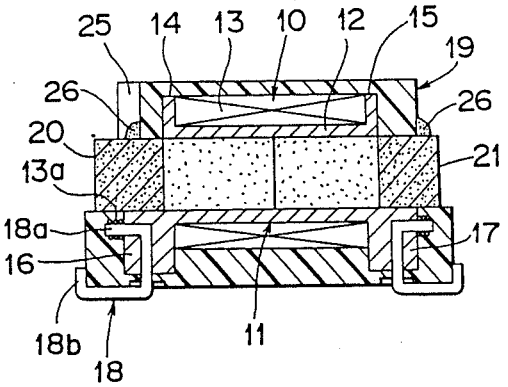
FIG. 12 is a sectional view of the inductance element of FIG. 11.

Another alternative design for a surface-mounted-type inductance element in accordance with the present invention is illustrated in FIGS. 9 to 12. This alternative design is substantially similar to the surface-mounted-type inductance element of FIGS. 7 and 8 except that the plate-like top portion 19c of the resin mold 19 is provided at one of its four sides with a notch 25 in place of the recess 24, which notch 25 serves as a mark to specify the primary side of the coil like the recess 24 of the inductance element shown in FIGS. 7 and 8; the cores 20 and 21 are bonded to the resin mold 19 with ultraviolet-curing adhesives 26 as shown in FIGS. 11 and 12; and the base portion 19a of the resin mold 19 is formed at its bottom, from which the second projecting portions 18b of the external terminals 18 project downward, with recesses 27 as shown in FIG. 10. In the alternative design of FIGS. 9 to 12, components which are similar to those shown in FIGS. 2 to 8 are designated with like reference numerals and the description of them will not be repeated. An example of adhesives 26 for bonding the cores 20 and 21 to the resin mold 19, varnish and epoxy adhesive may be employed. However, in the case where varnish or epoxy adhesives are applied between the cores 20 and 21 and the resin mold 19, if the inductance element is cleaned with an organic solvent which is generally used for cleaning a hybrid IC or the like, such solvent may bring about separating of the varnish or the epoxy adhesive, resulting in the cores 20 and 21 tending to slip off the resin mold. Further, in the case where epoxy adhesives are employed, the cores 20 and 21 may be badly affected by bonding stress which will be produced when the epoxy adhesives are applied. Therefore, in the alternative design of FIGS. 9 to 12, ultraviolet-curing adhesives which do not bring about the above-described troubles are employed. More particularly, the ultraviolet-curing adhesives 26 are applied between the top portion 19c of the resin mold 19 and the cores 20 and 21, whereby the cores 20 and 21 are bonded to the resin mold 19. Even though the inductance element which has the cores 20 and 21 bonded to the resin mold 19 with the ultraviolet-curing adhesives 26 is cleaned with an organic solvent which is generally used for cleaning a hybrid IC or the like, such organic solvent will not allow the ultraviolet-curing adhesives 26 to be released from the bonding interfaces of the top portion 19c of the resin mold 19 and the cores 20 and 21, so that the cores 20 and 21 can be stably bonded to the resin mold 19 by the ultraviolet-curing adhesives 26. As an example of the ultraviolet-curing adhesive, there may be preferably used modified acrylate, which has excellent solvent resistance and is anaerobic, for example, being commercially available as LX-3521 (provided by Japan Loctite Corporation). Also, in the case where ultraviolet-curing adhesives having viscosity more than 5000 cP/cm are used, such adhesives will not flow to areas other than applied areas between the cores and the resin mold 19 due to its viscosity and will be prevented from flowing due to the decreasing of its viscosity which will be brought about on the curing of the adhesives, so that it is desirable to use such adhesives. The adhesives 26 can be rapidly cured by irradiating ultraviolet rays to the adhesives, so that the cores 20 and 21 will not be badly affected by bonding stress which may be produced by applying of the adhesives 26. Preferably, the adhesives 26 are applied to middle portions of the cores 20 and 21 which are less subjected to bonding stress, which may be produced by applying of the adhesives 26, in a magnetic circuit. In the alternative design of FIGS. 9 to 12, the adhesives 26 are applied to two points between the top portion 19c of the resin mold 19 and the cores 20 and 21. More particularly, in this alternative design, the top portion 19c of the resin mold 19 is formed with the notch 24 at its portion which positionally corresponds to a middle portion of the core 20 when the core 20 is assembled to the coil structure 10 through the resin mold 19 as shown in FIGS. 11 and 12, and the adhesives 26 are applied between an upper surface of the core 20 and surfaces of the top portion 19c which form the notch 24 and between a portion of the top portion 19c of the resin mold 19, which is opposite to and is in alignment with the forming position of the notch 24, and an upper surface of the core 21. Thus, the cores 20 and 21 are bonded to the resin mold 19 with the adhesives 26.

As described above, the second portions 18b of the external terminals 18 are bent for compatibility with surface-mounting of the inductance element. When bending operation of the second portions 18b are carried out, bending stresses may be produced intensively at roots of the second portions 18b. As a result, cracks or other discontinuities occur in the roots of the second portions 18b thereby causing the second portions 18b to tend to break. In the inductance element of FIGS. 9 to 12, the base portion 19a of the resin mold 19 is formed with the recesses at positions of its bottom which positionally correspond to positions of the bottom of the base portion 19a from which the second portions 18b of the external terminals 18 project outwardly, so that, when the bending operation of the second portions 18b are carried out, bending stresses will be prevented from being produced intensively at the roots of the second portions 18b. Therefore, in the inductance element of FIGS. 9 to 12, it is possible to avoid occurrence of cracks or other discontinuities in the second portions 18b of the external terminals 18.

Figure 13:
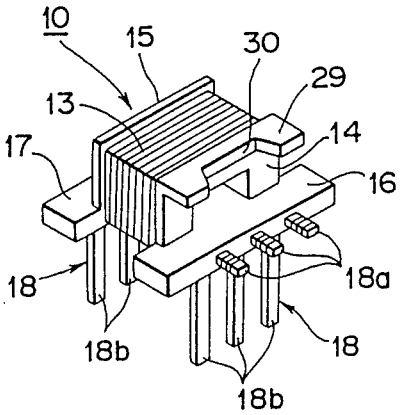
FIG. 13 is a schematic perspective view similar to FIG. 2 but showing a coil structure of yet another form of the present invention wherein one of the flanges of the coil structure is formed with a plate-like projection which projects laterally from the flange and the plate-like projection itself has a notch serving as means to specify a direction of the inductance element.
Figure 14:
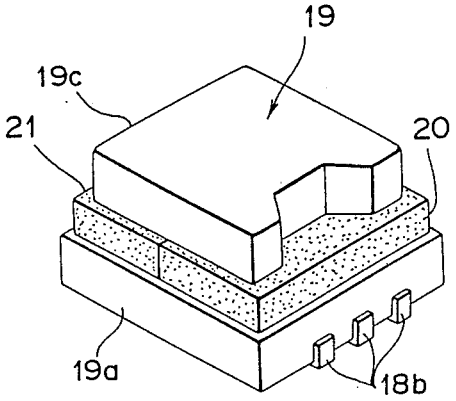
FIG. 14 is a schematic perspective view of an inductance element having the coil structure of FIG. 13.

Still another alternative design for a surface-mounted-type inductance element in accordance with the present invention is shown in FIGS. 13 and 14. This alternative design is substantially similar to the surface-mounted-type inductance element of FIGS. 9 to 12 except that one of the flanges 14 and 15 of the coil structure 10, namely, the flange 14 is formed with a plate-like projection 29 which projects laterally from the upper edge portion of the flange 24; the plate-like projection 29 of the flange 14 itself has a notch 30 serving as means to specify a direction of a transformer, for example, the primary side of the coil; and the coil structure 19 is covered with the resin mold 19 in a manner such that the appearance of the notch 30 of the plate-like projection 29 appears clearly as shown in FIG. 14. In FIG. 14, the adhesives which are used for bonding the cores 20 and 21 to the resin mold 19 are not shown. However, the adhesives may be applied to in the same manner as done in the surface-mounted-type inductance element of FIGS. 9 to 12.

While the E-shaped cores in a pair are employed in the above-described embodiments, an E-shaped core and an I-shaped cores in a pair can be also employed. In addition, while the surface-mounted-type inductance element constituting a closed magnetic circuit is referred to in the foregoing, this invention is equally well applicable to a surface-mounted-type inductance element which is adapted to constitute an open magnet circuit. Furthermore, this invention is applicable to a surface-mounted-type inductance element in which a toroidal core is employed.

As described above, in the surface-mounted-type inductance element in accordance with this invention, the coil structure is covered with the mold which is formed of resin material having heat resistance and solvent resistance. Thus, it will be noted that the surface-mounted-type inductance element can be automatically mounted on a printed circuit board by soldering without causing its magnetic characteristics to deteriorate. In addition, moisture resistance is also attributed to the resin mold, so that the reliability of the surface-mounted-type inductance element in accordance with the present invention is improved.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A surface-mounted-type inductance element comprising:

a coil structure having a bobbin, said bobbin including a portion around which wires are coiled, a pair of flanges integrally formed at opposing ends of said bobbin, a pair of bases integrally formed at lower edge portions of said flanges in a manner to project laterally from said flanges, and a plurality of external terminals attached to each of said bases in a manner to penetrate each said base, each said external terminal including a first portion projecting laterally from said base and a second portion projecting downward from said base, around which first portion of each said external terminal a termination of any one of said wires is wound;

a mold covering said coil structure in a manner to allow said second portions of said external terminals to be projected outward from said mold, said mold being formed of resin material exhibiting heat resistance; and a pair of cores assembled to said coil structure through said resin mold.

2. A surface-mounted-type inductance element as defined in claim 1, wherein said mold is formed of resin material which has solvent resistance as well as heat resistance.

3. A surface-mounted-type inductance element as defined in claim 1, wherein said mold comprises a horizontal plate-like base portion enclosing said bases of said coil structure and said first portions of said external terminals, a step portion enclosing an essential part of said bobbin, and a horizontal plate-like top portion lying on said step portion in parallel with said base portion of said resin mold; and said cores are seated with respect to said step portion of said resin mold.

4. A surface-mounted-type inductance element as defined in claim 3, wherein said top portion of said mold is relatively smaller than said base portion of said mold.

5. A surface-mounted-type inductance element as defined in claim 1, wherein said cores constitute a closed circuit.

6. A surface-mounted-type inductance element as defined in claim 1, wherein said cores are tightly fastened to said coil structure through said mold by means of clips.

7. A surface-mounted-type inductance element as defined in claim 1, wherein said second portion of each of said external terminals is bent along an outer surface of said mold in a manner to be flattened.

8. A surface-mounted-type inductance element as defined in claim 1, wherein said termination of each said wire is fixed to the corresponding first portion of said external terminal by spot welding or high-frequency welding which is capable of momentarily completing the fixing operation.

9. A surface-mounted-type inductane element as defined in claim 1, wherein said flanges of said bobbin are partially exposed from said mold, and a top surface of and both ends of each said base are exposed from said mold.

10. A surface-mounted-type inductance element as defined in claim 3, wherein said top portion of said mold is formed at one of its four sides with a recess which serves as means to specify a direction of said inductance element.

11. A surface-mounted-type inductance element as defined in claim 1, wherein said cores are fixed to said resin mold by means of ultraviolet-curing adhesives.

12. A surface-mounted-type inductance element as defined in claim 11, wherein said adhesives are formed of modified acrylate which is anaerobic and has viscosity more than 5000 cP/cm.

13. A surface-mounted-type inductance element as defined in claim 11, wherein each of said cores is fixed at its substantially middle portion to said mold by each said adhesive.

14. A surface-mounted-type inductance element as defined in claim 11, wherein said mold comprises a horizontal plate-like base portion enclosing said bases of said coil structure and said first portions of said external terminals, a step portion enclosing an essential part of said bobbin, and a horizontal plate-like top portion lying on the step portion in parallel with said base portion of said resin mold; and said cores fixed to said resin mold by said adhesives in a manner to be seated with respect to said step portion of said resin mold.

15. A surface-mounted-type inductance element as defined in claim 14, wherein said base portion of said mold is formed with recesses at points of its bottom, from which said second portions of said external terminals project outward, each said recess formed in a manner to surround the corresponding second portion of said external terminal, and each of said second portions of said external terminals is bent along an outer surface in a manner to be flattened.

16. A surface-mounted-type inductance element as defined in claim 11, wherein said termination of each said wire is fixed to the corresponding first portion of said external terminal by spot welding or high-frequency welding which is capable of momentarily completing the fixing operation.

17. A surface-mounted-type inductance element as defined in claim 14, wherein said flanges of said bobbin are partially exposed from said mold, and a top surface of and both ends of each said base are exposed from said mold.

18. A surface-mounted-type inductance element as defined in claim 14, wherein said top portion of said mold is relatively smaller than said base portion of said mold.

19. A surface-mounted-type inductance element as defined in claim 14, wherein said top portion of said mold is formed at one of its four sides with a notch which serves as means to specify a direction of said inductance element.

20. A surface-mounted-type inductance element as defined in claim 19, wherein said cores are fixed to said top portion of said mold by applying said adhesives between surfaces forming said notch and one of said cores, and between the other of said cores and a portion of said top portion of said resin mold which is opposite to and in alignment with the forming position of said notch.

21. A surface-mounted-type inductance element as defined in claim 1, wherein one of said flanges of said coil structure is formed with a plate-like projection which projects laterally from said flange, said plate-like projection itself having a notch serving as means to specify a direction of said inductance element, and said coil structure is covered with said mold in a manner such that the appearance of said notch of said plate-like projection appears clearly.

22. A surface-mounted-type inductance element as defined in claim 1, wherein said cores are tightly fastened by means of clips to said coil structure covered with said mold.

23. A surface-mounted-type inductance element as defined in claim 15, wherein said top portion of said mold is relatively smaller than said base portion of said mold.

24. A surface-mounted-type inductane element as defined in claim 15, wherein said top portion of said mold is formed at one of its four sides with a notch which serves as means to specify a direction of said inductance element.

25. A surface-mounted-type inductance element as defined in claim 17, wherein said top portion of said mold is relatively smaller than said base portion of said mold.

26. A surface-mounted-type inductance element as defined in claim 17, wherein said top portion of said mold is formed at one of its four sides with a notch which serves as means to specify a direction of said inductance element.

27. A surface-mounted-type inductance element as defined in claim 18, wherein said top portion of said mold is formed at one of its four sides with a notch which serves as means to specify a direction of said inductance element.

28. A surface-mounted-type inductance element as defined in claim 1, wherein said cores are tightly fastened to said coil structure through said mold bu means self-adhering tapes.

29. A surface-mounted-type inductance element as defined in claim 1, wherein said cores are tightly fastened by means of self-adhering tapes to said coil structure covered with said mold.

* * * * *